United States Patent [19]

Budano, II et al.

[11] Patent Number: 4,892,491

[45] Date of Patent: Jan. 9, 1990

[54] COAXIAL CONNECTOR

[75] Inventors: Joseph A. Budano, II, Plantation; Andrzej T. Guzik, Pompano Beach; Rudy Yorio, Boca Raton; Harold M. Cook, Sunrise, all of Fla.

[73] Assignee: Motorola, Inc., Schaumburg, Ill.

[21] Appl. No.: 286,185

[22] Filed: Dec. 19, 1988

[51] Int. Cl.[4] ..... H01R 17/18

[52] U.S. Cl. ..... 439/582; 439/578; 439/840

[58] Field of Search ..... 439/839, 840, 841, 819, 439/816, 578–585, 675, 824, 677, 680, 607–610

[56] References Cited

U.S. PATENT DOCUMENTS

| | | | |
|---|---|---|---|
| 2,757,351 | 7/1956 | Klostermann | 439/583 |
| 2,983,779 | 5/1961 | Dumire et al. | 439/578 |
| 3,208,033 | 9/1965 | Blonder | 439/839 |
| 3,467,940 | 9/1969 | Wallo | 439/578 |
| 3,812,310 | 5/1974 | Gasparaitis et al. | 200/51 |
| 3,946,390 | 3/1976 | Alexander et al. | 343/702 |
| 4,189,203 | 2/1980 | Miller | 439/680 |
| 4,227,765 | 10/1980 | Neumann et al. | 439/578 |
| 4,509,816 | 4/1985 | Freitag | 439/585 |
| 4,636,015 | 1/1987 | Ford, Jr. | 339/14 |
| 4,690,471 | 9/1987 | Marabotto et al. | 439/63 |

FOREIGN PATENT DOCUMENTS

| | | | |
|---|---|---|---|
| 0520028 | 4/1940 | United Kingdom | 439/839 |

*Primary Examiner*—David Pirlot
*Attorney, Agent, or Firm*—Daniel K. Nichols

[57] ABSTRACT

A coaxial connector includes a housing carrying an insulator. The insulator carries a center contact with a spring biasing the cneter contact. A volute spring engages the housing and provides the ground or shield contact. The housing is formed of two halves with the volute spring and alignment pins holding the housing halves together. A coaxial cable has its shield clamped between the housing halves for providing the ground connection to the volute spring. The coaxial cable center conductor is connected to the center contact within the housing.

13 Claims, 2 Drawing Sheets

COAXIAL CONNECTOR

BACKGROUND OF THE INVENTION

This invention relates to coaxial connectors in general, and particularly to coaxial connectors having spring loaded contacts. Coaxial connectors are generally utilized in conjunction with coaxial cable for providing impedance matched and shielded RF connections. For DC and low frequency connectors the inductance of a coil spring as part of the connection path is often insignificant However, at radio frequencies, for examples the frequencies in the UHF or VHF range, components such as springs can present impedance mismatches in a connector where the spring provides the electrical RF connection. Various nonspring RF connectors have a center pin that is received in a mating receptacle. The mating outer contacts interlock as by threaded or bayonet connection. For applications such as mating with a substantially flat or flush coaxial connector it is necessary to provide biasing of at least one of the coaxial contacts in order to accommodate tolerance variations that may prevent the making of good electrical connection due to variations in the planes of the contacts.

SUMMARY OF THE INVENTION

This coaxial connector provides both spring loaded center and outer contacts while exhibiting good impedance characteristics and shielding. The connector includes a housing which carries an insulator. A resiliently biased center contact is carried by the insulator. A volute spring electrically engages the housing to provide an outer contact.

In one aspect of the invention, the housing includes housing halves. The volute spring is located about the housing halves for locking the housing. The volute spring includes a plurality of fingers providing the outer contact.

In another aspect of the invention, the contacts are located about a first axis and a coaxial cable is received by the housing on a second axis. The coaxial cable center conductor is directly connected to the center contact within the housing. The coaxial cable shield is clamped between the halves of the housing.

DESCRIPTION OF THE PREFERRED EMBODIMENT

Figure 1:
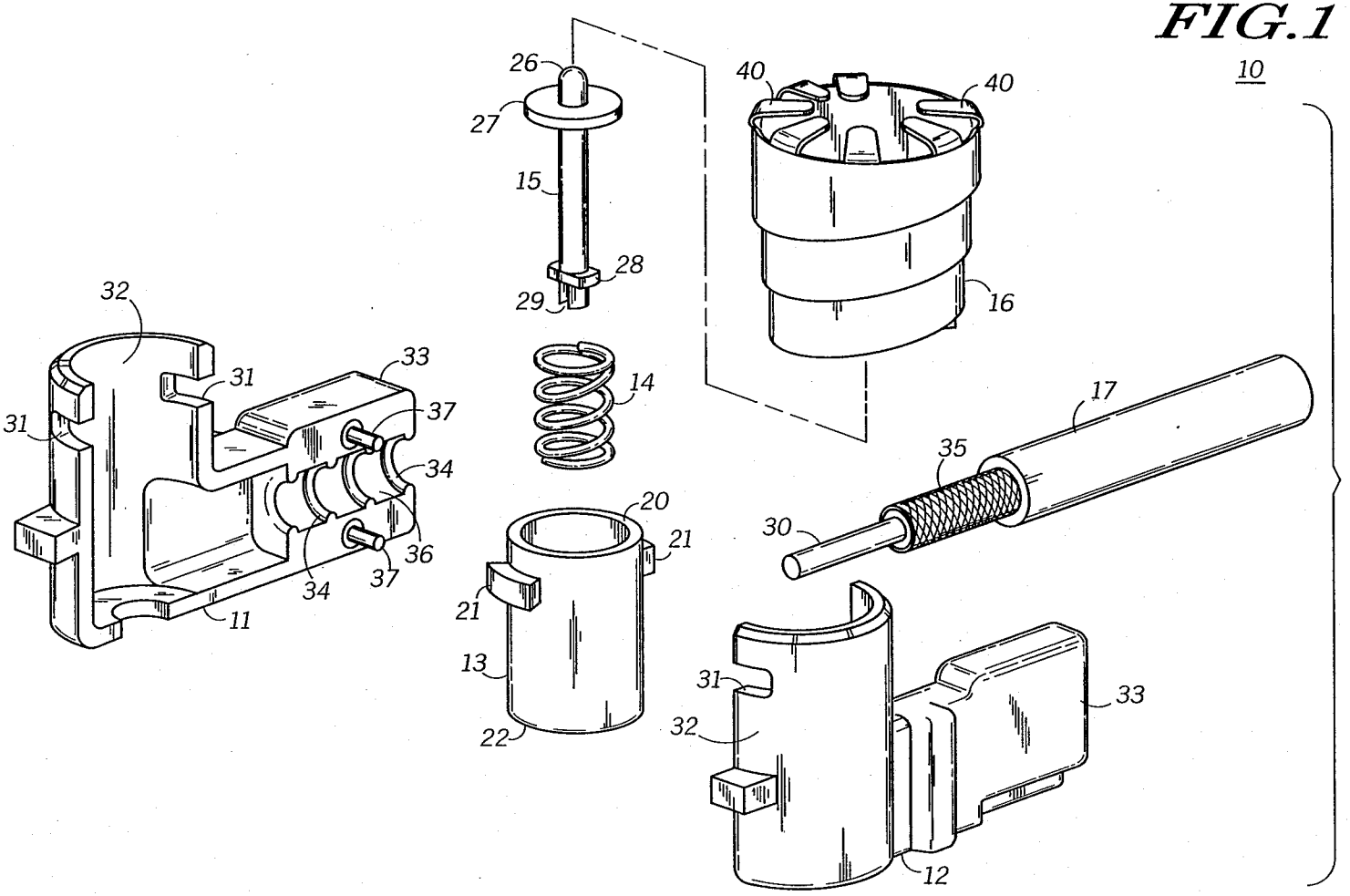
FIG. 1 is an exploded perspective view of a coaxial connector in accordance with the present invention.

Referring now by characters of reference to the drawings, and first to FIG. 1, it will be understood that the RF connector generally indicated by 10 includes first and second housing halves 11 and 12 which are preferably die cast metal or metalized plastic. An insulator 13 made of a plastic material of Teflon receives a helical compression spring 14 and a center connector 15. A volute spring 16 provides an outer ground contact and shielding. The connector 10 is designed to be connected to a coaxial cable 17.

Figure 2:
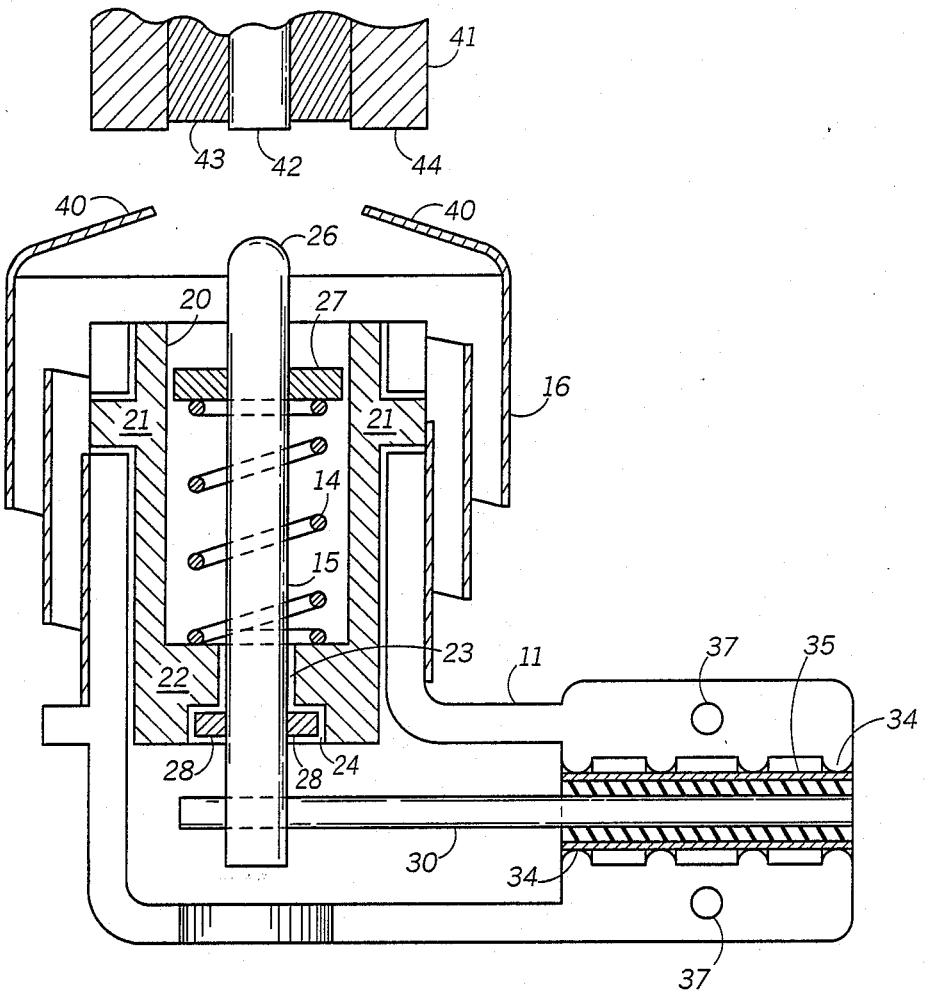
FIG. 2 is a cross sectional view of the assembled coaxial connector of FIG. 1.

The insulator 13 is a substantially hollow cylinder having an open top end 20, a pair of side ears 21, and as is more clearly seen in FIG. 2, a partially closed lower end 22. The lower end 22 includes a through slot 23 and a keyed or indented area 24. The spring 14 is receivable in the insulator 13 and seats against the lower end 22 of the insulator. The center connector 15 includes a contact 26 at its upper end. A shoulder or disc 27 is space from the contact 26 and engages the spring 14 within the insulator for resiliently biasing the center connector 15. Spaced from the lower end of center conductor 15 is a pair of keys or ears 28. The ears 28 pass through the slot 23 and the center connector 15 is then rotated during assembly to seat the ears in the indented area 24. The ears 28 prevent rotation of the center connector 15 during normal usage. A opening or slot 29 is provided at the lower end of center connector 15 to receive center conductor 30 of coaxial cable 17. Electrical and mechanical connection between these parts is made as by crimping and/or soldering.

The housing halves 11 and 12 are substantially coplementary or mirror image parts. Each of the halves includes key members or slots 31 at their adjoining margins for receiving and fixturing the ears 21 of insulator 13. The slots 31 are located in half cylinder portions 32 in which the insulator 13 is located. The half cylinder portions 32 are centered around the contact axis of the coaxial connector 10. Clamping portions 33 of housing halves 11 and 12 include half cylindrical passages 36 about an axis which is substantially perpendicular to the contact axis. The passages 36 include a plurality of ribs 34 for electrically and mechanically engaging the shield or braid 35 of coaxial cable 17. The clamping portion 33 of housing half 11 includes a pair of press fit alignment pins 37 which are received in complementary holes (not shown) in the clamping portion 33 of housing half 12. These provide alignment means and partially lock the housing assembly of halves 11 and 12.

The volute spring 16 is positioned about the outside of the half cylindrical portions 32 of housing halves 11 and 12. The volute spring 16 mechanically holds and locks the housing halves 11 and 12 together and makes an electrical connection to the housing assembly. At its upper edge the volute spring 16 includes a plurality of folded fingers 40 which provide the ground or outside contact of the coaxial connector 10.

As is illustrated in FIG. 2, a mating connector 41 includes a center contact 42 surrounded by a coaxial insulator 43 and then a coaxial outer contact 44. It will be understood that both the center connector 15 and the volute spring 16 are resilient so that when the coaxial connector 10 is positioned against the mating connector 41 under force, reliable connection is made at both the center and outside contacts. Within reasonable limits the center connector 15 and ground connector 16 can tolerate considerable variations in the planes of the center contact 42 and outside contact 44. If the center contact 26 engages the center contact 42, the center connector 15 will be relatively depressed into the connector 10, as the connector 10 is moved further toward and against the connector 41. The coaxial cable center conductor 30 bends or flexes allowing longitudinal movement of center conductor 15 against the resilient force of coil spring 14. The fingers 40 will engage the contact 44 and the volute spring 16 will allow for longitudinal or axial compression as coaxial connector 10 is further biased or forced against the connector 41. Similarly the volute spring 16 can first engage the outer contact 44 or both contacts could simultaneously engage the contacts of connector 41. Reliable connection will be maintained as long as pressure is applied to hold the coaxial connector 10 against the mating connector 41.

Various mechanical clamping arrangements can be utilized depending upon the particular device with which the connector 10 is utilized. For example, the coaxial connector can be utilized a a portable communications device adaptor such as that illustrated in U.S. patent application Ser. No. 279,002 filed Dec. 2, 1988 owned by the assignee of the present invention, the disclosure of which is incorporated herein by reference. The use of a flush connector like connector 41 on a portable radio is illustrated in U.S. Pat. No. 4,636,015, the disclosure of which is also hereby incorporated by reference.

We claim as our invention:

1. A coaxial connector comprising:
a housing
an insulator carried in the housing;
a center contact carried by the insulator;
a resilient means biasing the center contact; and
a volute spring located about the housing, electrically engaging the housing and providing an outer contact.

2. A coaxial connector as defined in claim 1, in which:
the center contact include a keyed portion, and
the insulator includes a keyed portion receiving the center contact keyed portion.

3. A coaxial connector as defined in claim 1, in which:
the center and outer contacts are located about a first axis of the housing, and
a coaxial cable is received by the housing on a second axis.

4. A coaxial connector as defined in claim 3, in which:
the first and second axes are substantially perpendicular.

5. A coaxial connector as defined in claim 4, in which:
the coaxial cable includes a center conductor which is directly connected to the center contact within the housing.

6. A coaxial connector as defined in claim 7, in which:
the volute spring includes a plurality of fingers providing the outer contact.

7. A coaxial connector comprising:
a housing having complementary housing halves;
an insulator carried in the housing;
a center contact carried by the insulator;
a resilient means biasing the center contact; and
a volute spring located about the housing halves, electrically engaging the housing and providing an outer contact.

8. A coaxial connector comprising:
a housing;
an insulator carried in the housing;
a center contact carried by the insulator;
a resilient means biasing the center contact; and
a volute spring electrically engaging the housing and providing an outer contact;
the center and outer contacts being located about a first axis of the housing
the housing including housing halves, and
the coaxial cable including a shield section clamped between the housing halves.

9. A coaxial connector as defined in claim 8, in which:
the housing haves include a plurality of ribs which electrically and mechanically engage the shield section.

10. A coaxial connector comprising:
a housing having two halves;
an insulator carried in the housing;
a center contact carried by the insulator;
a resilient means biasing the center contact; and
a volute spring providing an outer contact and engaging the housing halves to hold the housing together.

11. a coaxial connector as defined in claim 10, in which:
the center and outer contacts are located about a first axis of the housing, and
a coaxial cable is received by the housing on a second axis, the first and second axes are substantially perpendicular.

12. A coaxial connector as defined in claim 11, in which:
the coaxial cable includes a shield section clamped between the housing halves.

13. A coaxial connector as defined in claim 12, in which:
the coaxial cable includes a center conductor which is directly connected to the center contact within the housing.

* * * * *